US006218997B1

(12) United States Patent
Lindenmeier et al.

(10) Patent No.: US 6,218,997 B1
(45) Date of Patent: Apr. 17, 2001

(54) ANTENNA FOR A PLURALITY OF RADIO SERVICES

(75) Inventors: Heinz Lindenmeier, Planegg; Jochen Hopf, Haar, both of (DE)

(73) Assignee: FUBA Automotive GmbH, Bad Salzdetfurth (DE)

( * ) Notice: Subject to any disclaimer, the term of this patent is extended or adjusted under 35 U.S.C. 154(b) by 0 days.

(21) Appl. No.: 09/294,615

(22) Filed: Apr. 19, 1999

(30) Foreign Application Priority Data

Apr. 20, 1998 (DE) ..... 198 17 573

(51) Int. Cl.[7] ..... H01Q 21/00

(52) U.S. Cl. ..... 343/725; 343/729; 343/752; 343/767; 343/770

(58) Field of Search ..... 343/704, 713, 343/767, 770, 752, 725, 726, 727, 729, 730, 700 MS, 702, 829, 849, 848, 852; H01Q 1/00, 21/00

(56) References Cited

U.S. PATENT DOCUMENTS 4,023,179 * 5/1977 Ikrath et al. ..... 343/713
5,012,255 * 4/1991 Becker ..... 343/704
5,748,152 * 5/1998 Glabe et al. ..... 343/767
5,850,198 * 12/1998 Lindenmeier et al. ..... 343/713
5,955,997 * 9/1999 Ho et al. ..... 343/767

* cited by examiner

*Primary Examiner*—Tho Phan
(74) *Attorney, Agent, or Firm*—Collard & Roe, P.C.

(57) ABSTRACT

The invention relates to a mobile antenna for a plurality of radio services in the form of a dipole or monopole, with an antenna conductor and with at least one flatly designed roof capacity disposed substantially vertical relative to the antenna conductor for a first radio service with polarization disposed vertically relative to the roof capacity. The roof capacity is designed in the form of a conductive board or a thin conductive layer. In order to create an antenna function for at least one additional radio service with polarization oriented parallel with the roof capacitance, at least one slot is incorporated in the conductive board or layer with the slot length selected to form a suitable impedance bandwidth. In order to decouple signals of an additional radio service, first and second connection points are formed on the edges of the slot, wherein the connecting points oppose each other.

10 Claims, 7 Drawing Sheets

ANTENNA FOR A PLURALITY OF RADIO SERVICES

BACKGROUND OF THE INVENTION

1. Field of the Invention

The invention relates to an antenna for a plurality of radio services in the form of a dipole or monopole.

2. The Prior Art

Antennas of this type are known from German Patent DE 193 10 226 A1. The antenna described in this patent has a capacitive surface and an antenna conductor disposed substantially perpendicular relative to this surface. Together with the conductive base surface, and the decoupling of the signals as specified in this patent via the coupling conductor 15, an antenna in the form of a monopole is used. Its direction of polarization extends substantially perpendicular to the top capacity. By arranging slots in the top capacity, the latter becomes electrically divided, depending on the frequency, so that for a monopole operation with polarization oriented perpendicular to the top capacity, a plurality of radio services are obtained on the antenna. Antennas of this type thus have the limitation that their polarization is oriented perpendicular to the top capacity. Thus it is not possible in the present state of the art for one singular antenna to communicate with several vertically polarized mobile terrestrial telephone radio services. Thus, it is not possible even if this one antenna uses either single or multifrequency communication with satellite radio services, whether linear or circularly polarized.

SUMMARY OF THE INVENTION

Therefore, it is an object of the invention to provide an antenna that provides both radio reception with a polarization perpendicular to the top capacity, and at least one additional radio service with parallel polarization relative to the top capacity. Thus this type antenna provides a combined function for radio services with planes of polarization disposed vertically, one on top of the other.

With the antenna according to the invention, it is possible to gain the advantage of covering, with one component, a great variety of terrestrial, and satellite radio services with very low cost. Particularly for mobile radio services, it is possible to design compact motor vehicle antennas which, cover the mobile telephone services GSM in the D-network (about 0.9 GHZ), and the E-network (about 1.8 GHZ) with vertical polarization, and at the same time, the satellite radio service for location determination (GPS radio service at about 1.5 Ghz). In this case, the waves arrive predominantly horizontally, and with circular polarization due to a plurality of a zenith close satellites. As opposed to the vertically polarized radio service with a gap in the directional diagram, or a pattern in the zenith, GPS navigation service requires a circularly polarized antenna and has a maximum reception at its zenith. This requirement can be advantageously satisfied at low expenditure with an antenna as defined by the present invention.

BRIEF DESCRIPTION OF THE DRAWINGS

Other objects and features of the present invention become apparent from the following detailed description considered in connection with the accompanying drawings which disclose the embodiments of the present invention. It should be understood, however, that the drawings are designed for the purpose of illustration only, not as a definition of the limits of the invention.

In the drawings, wherein similar reference characters denote similar elements throughout the several views.

DETAILED DESCRIPTION OF PREFERRED EMBODIMENTS

Figure 1A:
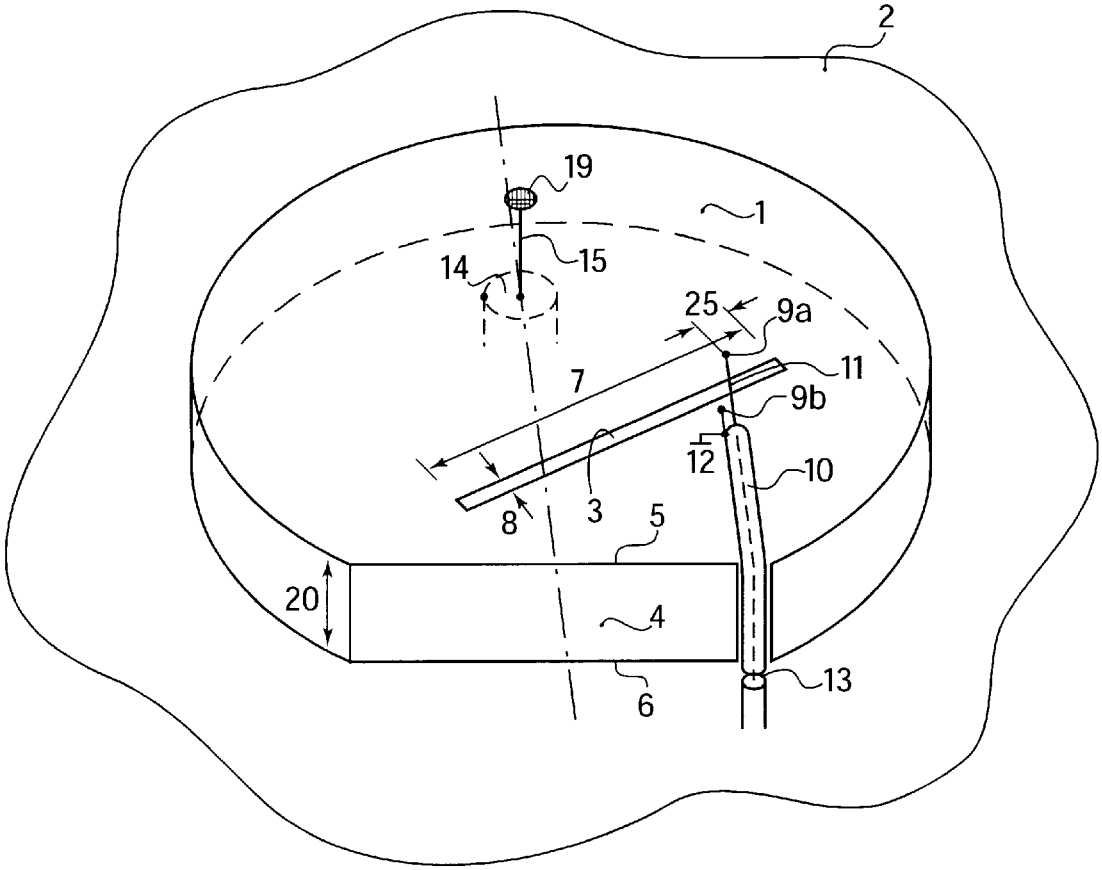
FIG. 1*a* shows an antenna in the form of a monopole as defined by the invention, with a flat antenna conductor connected to the base surface having a roof capacity and a closed lambda/2 slot contained therein.

Turning now in detail to the drawings, FIG. 1*a* shows an antenna in the form of a monopole with a flatly designed antenna conductor 4, which is conductively connected to both the top capacity 1 and the base surface. A resonance is formed in the frequency range of a first radio service by the inductive effect of antenna conductor 4 and the capacitive effect of the top capacity. It is possible in this way to form a resonant monopole antenna with a low structural height with vertical polarization relative to the top capacity. Coupling to the resonant monopole, takes place via coupling conductor 15 for forming the first antenna connection point 14. In order to obtain the required antenna function with parallel polarization relative to the roof capacity for a further radio service using a monopole, a closed lambda/2 slot 3 with resonance in the frequency range of this further radio service is provided in roof capacity 1. A slot with about lambda/4 length that is open at one end can be formed as well. Suitably selected connection points 9*a* and 9*b*, which oppose each other on the edges of the slot, with a spacing 25 from the closed end of the slot, permit adjustment of the desired antenna impedance. Moreover, the width of the slot permits adjustment of the desired bandwidth. A non symmetrical line 10, is connected to connection points 9*a*, 9*b*, and is electrically neutral with respect to the monopole function of the antenna. Line 10 is installed parallel with the conductive surfaces of roof capacity 1 and antenna conductor 4, and connected between connection points 9*a* and 9*b*. A further antenna connection point 13 is located on the conductive base surface 2.

Figure 1B:
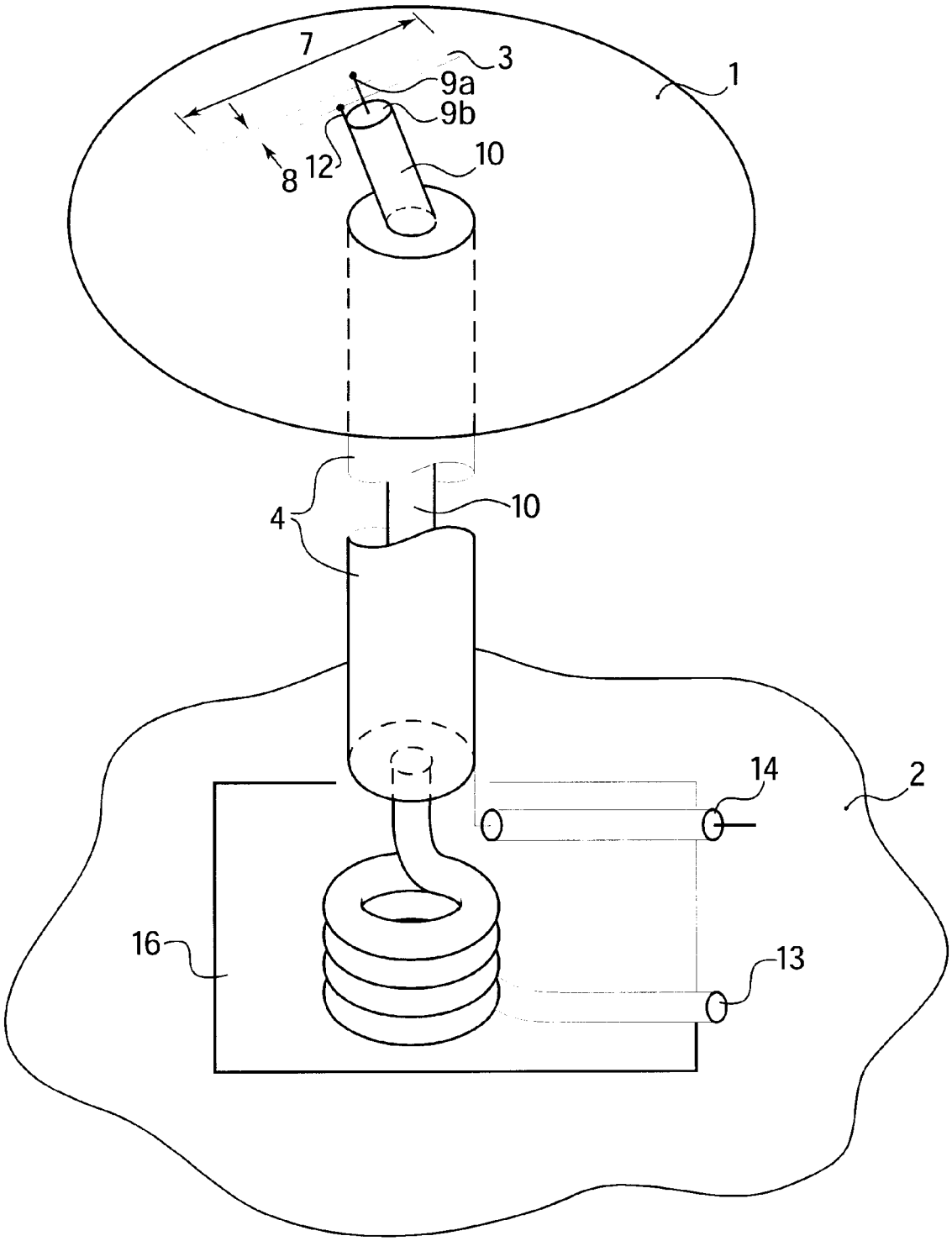
FIG. 1*b* shows the antenna of FIG. 1*a*, but with a tubular antenna conductor with a non symmetrical line in the field-free interior of the latter, and with a frequency separating filter present on the base surface.

FIG. 1*b*. shows an antenna in the form of a monopole as in FIG. 1*a* but with a tubular antenna conductor 4. The non symmetrical line 10 is installed in the field-free interior of this conductor. The first antenna connection point 14 is formed at the lower end of antenna conductor 4 with the conductive base surface 2. To extend the antenna connection for additional radio service, a frequency separation filter 16 is formed at or in the bare point. In the interior of the filter, the extension of a non symmetrical line 10 is provided in the form of a choke coil that has a high impedance in the first frequency range. Antenna connection point 13 is designed not to impair the monopole function of the antenna.

Figure 2:
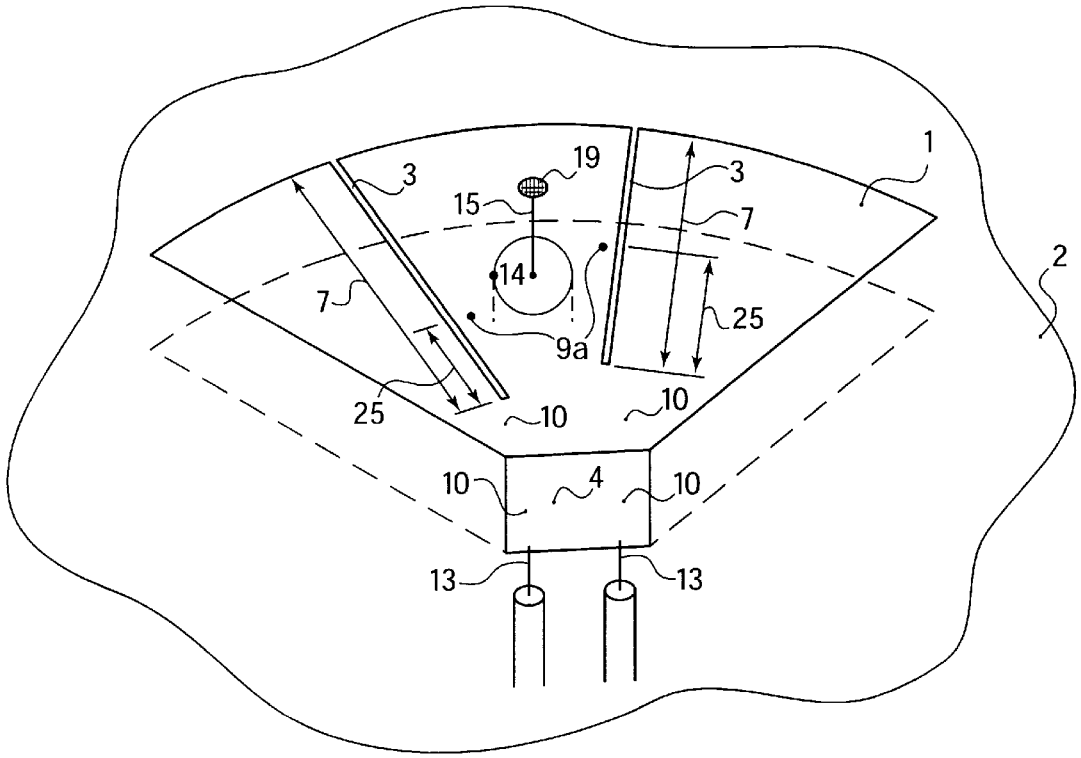
FIG. 2 shows the antenna of FIG. 1*a*, but with conductor boards coated on both sides and with two open lambda/4-elongated slots of different lengths for receiving two additional radio services at different frequencies.

In FIG. 2, roof capacity 1 and the vertically oriented, flatly designed antenna conductor 4 are designed as conductor boards which are coated on both sides, providing an advantageous embodiment to the invention. The conductive surfaces are formed by the conductive material present on the one side of the conductor boards, and the surfaces are electrically connected on the abutting edge. The non symmetrical line is designed in the form of a strip line 10, whereby the strip conductor is printed on the opposite side of the conductive surface 1, and the surface forms the ground conductor of line 10. The connection between the strip conductor of strip line 10 and connection point 9*a* can be established simply way through-contacting. Connection point 9*b* is defined by the run of the strip conductor, which extends perpendicular to the direction of the slot—as the point on the edge of the slot opposing point 9*a*. To illustrate the idea of the invention, FIG. 2 shows two slots 3 with different lengths (approximately $\lambda/4$) and different directions of polarization within the two common polarization planes parallel with the roof capacity, with non symmetrical lines 10, which are separated from each other, and additional antenna connection points 13. It is possible in this way to cover additional radio services with different frequencies for the same polarization plane.

Figure 3A:
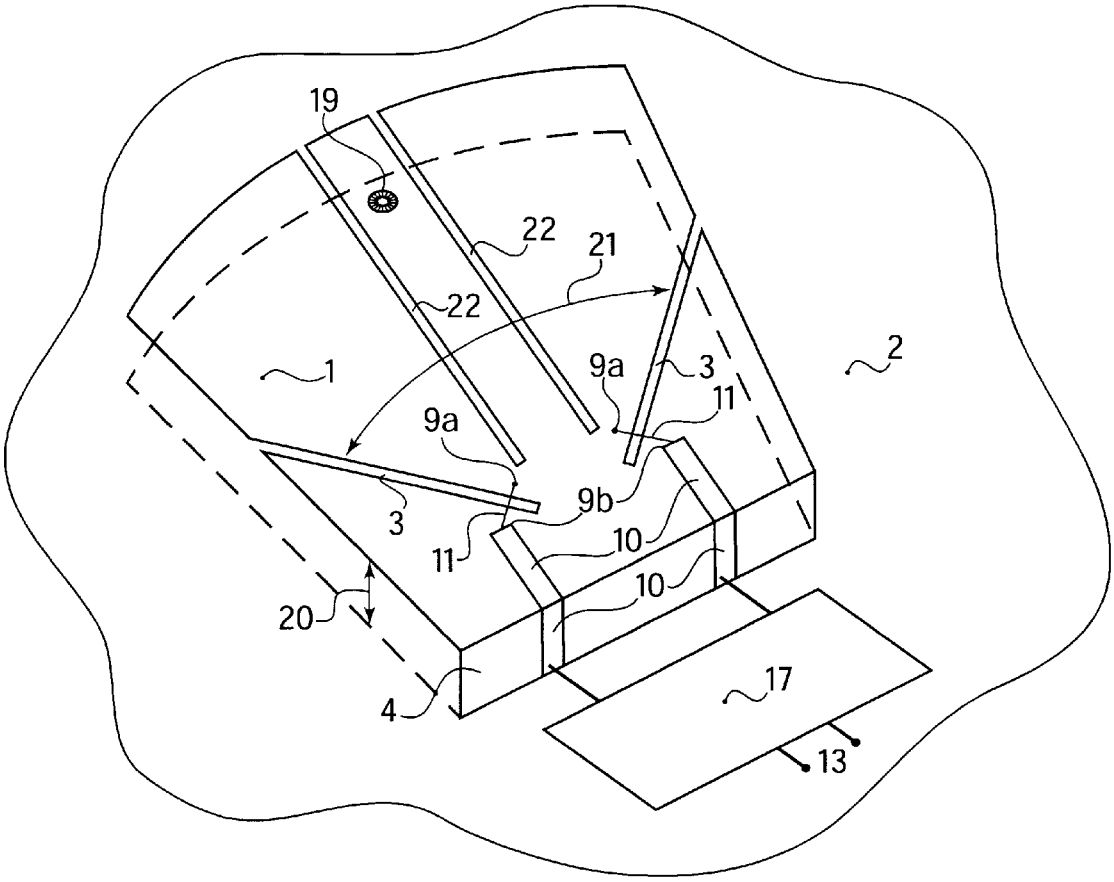
FIG. 3*a* shows the antenna of FIG. 2, but with two equally elongated slots arranged at an angle of about 90 degrees relative to each other.

As a further advantageous embodiment of the invention, FIG. 3*a* shows an antenna wherein the conductive base surface is oriented horizontally, and the monopole antenna is tuned for the frequency band of a terrestrial radio telephone service with vertical polarization as the first radio service, and further tuned to a satellite radio service with waves substantially incident with horizontal polarization as the second radio service.

Such an antenna is particularly suitable, for example for combining the terrestrial GSM telephone service with the GPS satellite radio service for application as a motor vehicle antenna with a horizontal conductive surface 2. In this case, the roof capacity and the antenna conductor 4, which is vertically oriented relative to said roof capacity, are dimensioned so that resonance exists in the GSM frequency range. Slot 3 is designed with respect to its length and width so that its resonance is suitable for receiving the GPS signals. In order to satisfy both the requirement of maximal radiation in the zenith, and at the same time, circular polarization, two slots 3 are provided, each with two connection points, whereby points 9*a* and 9*b* each have a non symmetrical line 10 connected thereto for the further GPS radio service with circular polarization. The slots in the conductive board of the roof capacity are oriented for this purpose at an angle of almost 90° relative to each other so that the reception of the circularly polarized waves is optimized with a preset direction of rotation. Both slots are designed, for example as lambda/4 resonant slot lines with open ends on the edge of the top capacity. The spacing 25 of connection points 9*a*, 9*b* is preferably selected with respect to the wave resistance of the line connected thereto. At their other ends, the two lines are connected to the two inputs of a 90° hybrid circuit, in which one of the two signals received is changed in the phase by 90° and, following the correctly polarized combination of the signals on the output of the hybrid circuit, the correct circular direction of polarization is present in antenna connection point 13.

An advantage of the invention is its simple design using printed conductor boards for producing the conductive surfaces and the lines. This technology permits, in the manufacturing process very good reproducibility of the finely coordinated structures. Roof capacity 1 and the vertically oriented, flatly designed antenna conductor 4 are designed in this connection as pc boards which are conductively coated on both sides, whereby the conductive material present on one side of the pc boards forms in each case, the conductive surface. The non symmetrical line 10 is designed in this case as a strip line, whereby the strip conductor is printed on the opposite side of the conductive surface, and the conductive surface forms the ground conductor of the line.

Figure 3B:
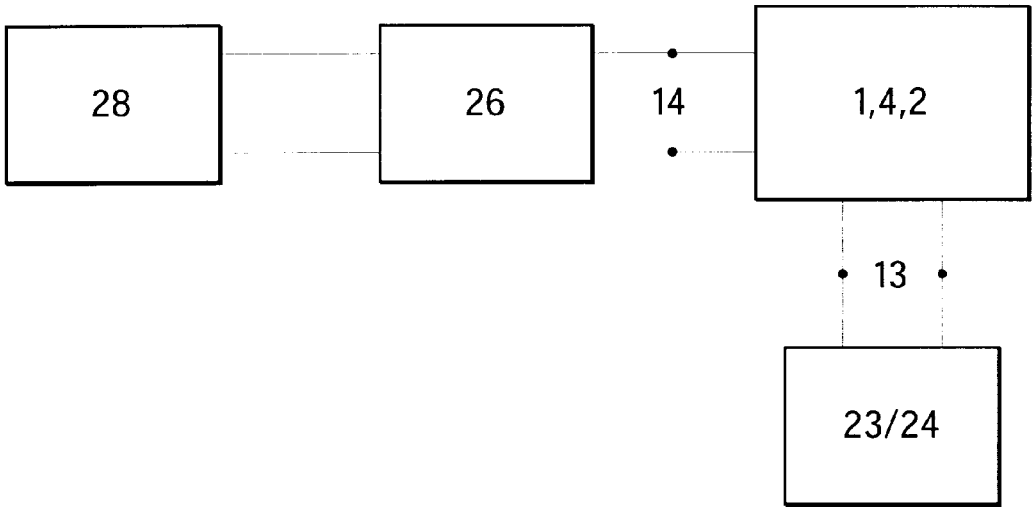
FIG. 3*b* is an electrical block diagram for an antenna as in FIG. 3*a*.

Relatively good decoupling between antenna connection points 13 and 14 is advantageous with the invention as well. Due to the extremely great differences of the signal strength between the emitted GSM-signals and the GPS-signals to be received, it is advantageous to connect a bandpass filter 27 for this frequency range downstream of antenna connection point 13 as shown in FIG. 3*b* in order to protect the sensitive GPS receiver against nonlinear effects caused by high signal levels, In order to achieve a good signal-to-noise ratio in the GPS range, it is advantageous to add a low-noise preamplifier 24 without loss-afflicted feed lines. In order to avoid the sideband noise of GSM radio transmitters 28 in the GPS frequency range, it is recommended that a band stop filter 26 be connected upstream of antenna connection point 14.

Figure 4:
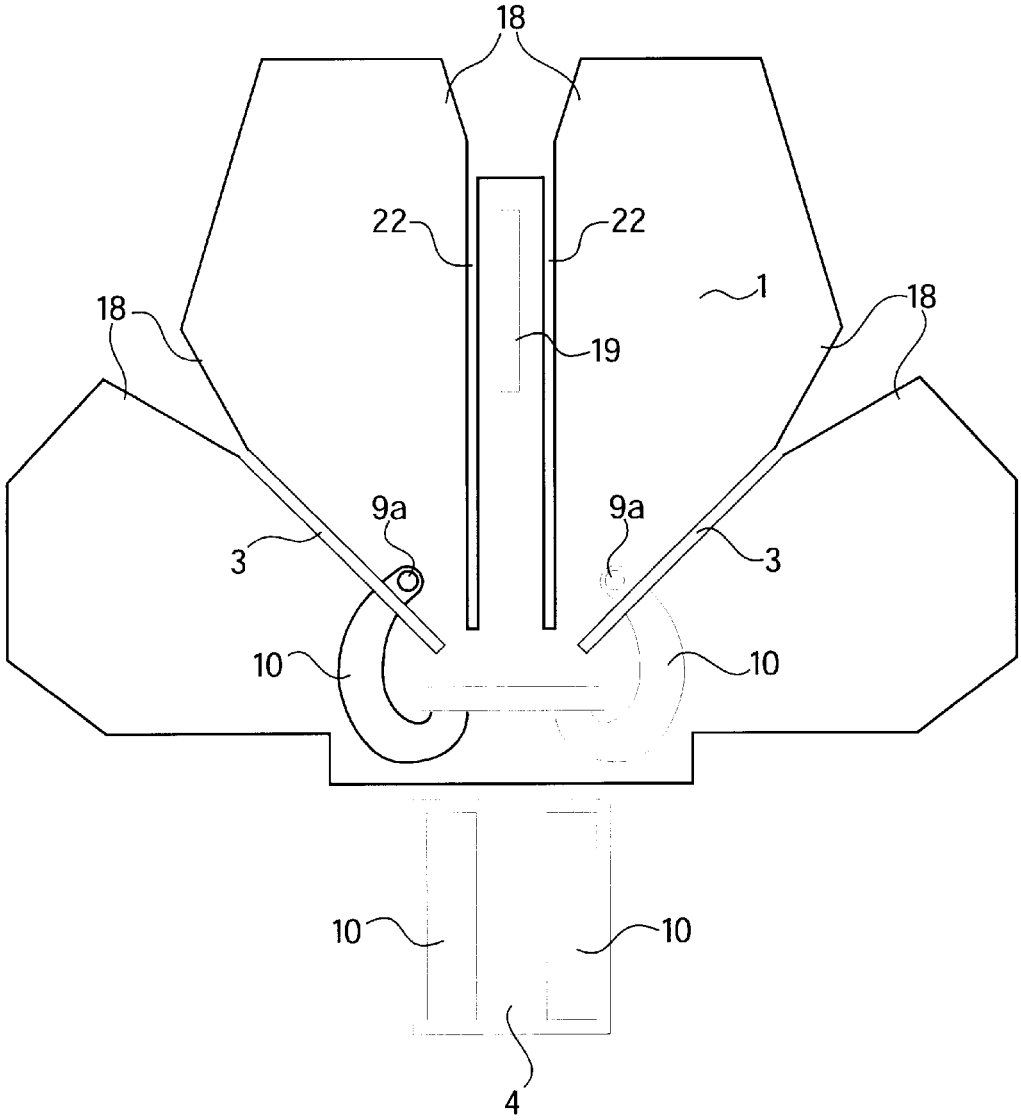
FIG. 4 shows the antenna according to FIG. 2, but for two first radio services (e.g., D-network, E-network) with vertical polarization relative to the top capacity, with two additional slots for forming different resonance frequencies.

To provide for an antenna function for an additional first radio service with a higher frequency and with a polarization with vertical orientation relative to the conductive base surface, it is possible to incorporate slots 22 in top capacity 1 in the manner known per se. FIG. 4 shows such an antenna for the two terrestrial mobile telephone services (D- and E-networks). With the help of the notches 18, it is possible to determine the slot lengths and the top capacity for forming the different resonance frequencies largely separated from each other.

With the antenna shown in FIG. 4 it is possible to receive in addition to the radio services of the D- and E-networks, the satellite navigation service GPS via a further connection point 13.

As opposed to the vertically polarized first radio service with a gap of the directional diagram in the zenith, the GPS navigation service requires a circularly polarized antenna with a maximum of the reception in the zenith. Two additional slots, which are arranged at an angle of 90 degrees relative to each other, are thus incorporated in the conductive surface of top capacity 1, and operated as lambda/4 slot antennas. The input impedance of the slots effective for the edge current of the D-network is sufficiently low impedance because the slots have a highly pronounced resonance at 1.575 GHZ, so that the radio antenna is not influenced in the D-network.

The decoupling points of the two GPS slot antennas are placed together as closely as possible and selected in such a way that their impedance amounts to 50 ohms. The HF-signals of the GPS antennas are conducted with coaxial lines via antenna conductor 4 to a 90-degree hybrid, using the conductive surface of roof capacity 1 as the ground conductor.

If doubly coated board material (e.g., FR4) of 1 mm thickness is employed for the conductive surface of roof capacity 1 for the antenna according to FIG. 4, all slots can be etched on the top side from the applied coating of copper. The two required HF-lines for GPS are realized as microstrip lines, whereby the underside of the board carries or supports the strip conductors. The GPS signals are passed on via antenna conductor 4 via microstrip lines as well and connected to the 90-hybrid on the base plate, the hybrid being designed in strip line technology as well. This results in an antenna which can be structured in a simple manner, and which is easily reproducible.

Figure 5:
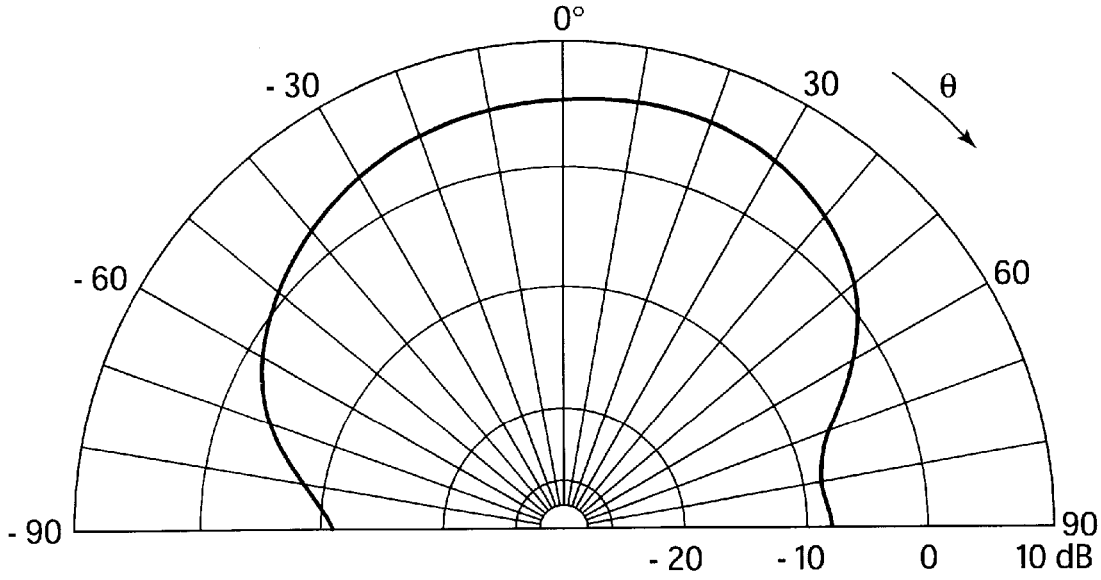
FIG. 5 shows the vertical directional diagram of an antenna of FIG. 4 in the GPS frequency band with circular polarization.

FIG. 5 is a plot of a measured vertical section of the directional diagram of the antenna according to FIG. 4 in the upper hemisphere with circular polarization. Due to the fact that the GPS slot antennas according to FIG. 4 are present in an environment which is non symmetrical, diagram catchments or losses are experienced in the 60° to 90° elevation range with respect to other azimuth angles. IEEE Standard Gain antenna with geometric dimensions adapted to the GPS frequency band was employed as reference antenna. The performance of a ceramic patch antenna is achieved in all other respects.

While several embodiments of the present invention have been shown and described, it is to be understood that many changes and modifications may be made thereunto without departing from the spirit and scope of the invention as defined in the appended claims.

What it is claimed:

1. A multiband-antenna for receiving a first radio service and at least one additional radio service, the multiband-antenna in the form of a monopole, comprising:

a conductive board comprising a thin conductive layer serving as a roof capacitance said conductive board having at least one slot having a slot length sufficient for forming a resonance in the frequency range of the at least one additional radio service, and a slot width for forming a suitable impedance bandwidth;

an antenna conductor disposed substantially perpendicular to said conductive board and for receiving the first radio service with vertically oriented polarization relative to the conductive board; and a first and a second connection point, respectively formed on the edges of said slot at points opposing each other for forming a horizontally polarized antenna for decoupling the signals of the at least one additional radio service.

2. The antenna, as recited in claim 1, further comprising a non-symmetrical electrical line having an inner conductor coupled to said first connection point, and having its ground conductor coupled to said second connection point, said non-symmetrical line being installed without electrically effective spacing, parallel with the conductive board forming the roof capacity, and also parallel with the surface of the antenna conductor.

3. The antenna according to claim 2, wherein said antenna conductor is designed flatly conductive and wherein said roof conductive board has a first edge and a second edge said antenna conductor conductively connected with the first edge to the roof capacitance, and conductively connected with the second edge to a conductive base surface an additional coupling conductor being disposed vertically relative to the conductive base surface and roof capacity and connected to a third connection point for the first radio service being formed between the conductive base surface and the end of the additional, vertically disposed coupling conductor facing said base surface.

4. The antenna according to claim 3, wherein the roof capacity and the flatly designed antenna conductor are designed as printed circuit or pc boards conductively coated on both sides, the conductive surface present on one side of the pc boards in each case forming the conductive surface; and wherein the non-symmetrical line is designed in the form of a strip line, whereby the strip line is printed on the opposite side of the conductive surface and the surface forms a ground conductor of the strip line.

5. The antenna according to claim 3, wherein creating an antenna function for an additional first radio service with a higher frequency and with polarization vertically oriented relative to the conductive base surface, slots are incorporated in the roof capacity.

6. The antenna according to claims 1, wherein a conductive base surface is disposed horizontally and the monopole antenna for the frequency band of a terrestrial telephone radio service with vertical polarization is tuned to said frequency band of said telephone radio service as the first radio service, and tuned or adapted to a satellite radio service with waves substantially incident with horizontal polarization, as the additional radio service.

7. The antenna according to claim 1, wherein the roof capacity and the antenna conductor disposed vertically relative to said roof capacity are dimensioned so that resonance exists in the first radio service (GSM frequency range), and that the length and width of said slot are dimensioned that its resonance is suitable for receiving the additional radio service (GPS).

8. The antenna according to claim 1, comprising a 90° hybrid circuit, and said slot comprises two slots each having two connection points and a non symmetrical line connected thereto for a further radio service with circular polarization, wherein the two lines are installed leading to the two inputs of said 90° hybrid circuit, the antenna connection point for the further radio service being formed on the output of said hybrid, and wherein the slots in the conductive board of the roof capacity are disposed relative to one another at an angle of almost 90° so that the reception of the circularly polarized waves is optimized with a preset rotational direction.

9. The antenna according to claim 8, comprising a frequency bandpass filter mounted in the further antenna connection point for passage of the signals for the further radio service, and a low-noise amplifier mounted on a conductive base surface of the antenna.

10. The antenna according to claim 1, wherein said antenna conductor is designed as a three-dimensional element and a non symmetrical line is installed either in the field-free interior of said antenna conductor or electrically ineffectively parallel with the outer surface of said antenna conductor and with a conductive base surface, and further comprising:

a frequency separation filter disposed on the conductive base surface, into which the non symmetrical line is inserted and to which the antenna conductor is connected, and on which either separated antenna connection points for all radio services are present.

* * * * *